US006380500B1

(12) United States Patent
Lin

(10) Patent No.: US 6,380,500 B1
(45) Date of Patent: Apr. 30, 2002

(54) ROCKER SWITCH AND SEAL ARRANGEMENT

(75) Inventor: Yu-min Lin, Milwaukee, WI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/577,425

(22) Filed: May 22, 2000

(51) Int. Cl.[7] ..... H01H 19/06
(52) U.S. Cl. ..... 200/302.3; 200/302
(58) Field of Search ..... 200/553, 306, 200/302.3

(56) References Cited

U.S. PATENT DOCUMENTS

| | | | | | |
|---|---|---|---|---|---|
| 2,334,901 | A | | 11/1943 | Bullerjahn | 200/172 |
| 2,726,105 | A | | 12/1955 | Koenig | 286/15 |
| 2,786,359 | A | | 3/1957 | Karlan et al. | 74/18.1 |
| 3,737,601 | A | * | 6/1973 | Arthur et al. | 200/76 |
| 3,742,171 | A | * | 6/1973 | Howe | 200/168 |
| 3,928,743 | A | * | 12/1975 | Ohashi | 200/308 |
| 4,021,630 | A | * | 5/1977 | Taylor | 200/159 |
| 4,218,602 | A | * | 8/1980 | Creech | 200/302 |
| 4,221,941 | A | * | 9/1980 | Genovese | 200/67 A |
| 4,429,200 | A | * | 1/1984 | Glenn et al. | 200/153 |
| 4,673,780 | A | | 6/1987 | Kenway | 200/302.2 |
| 4,943,694 | A | * | 7/1990 | Kroth | 200/332.1 |
| 4,947,010 | A | * | 8/1990 | Heydner et al. | 200/296 |
| 5,053,591 | A | * | 10/1991 | Theurer | 200/315 |
| 5,258,593 | A | * | 11/1993 | Hayakawa | 200/315 |
| 5,491,460 | A | * | 2/1996 | Krasser et al. | 337/70 |
| 5,558,211 | A | * | 9/1996 | Heydner et al. | 200/553 |
| 5,660,270 | A | | 8/1997 | Martin et al. | 200/315 |
| 5,735,932 | A | * | 4/1998 | Shirasaka | 200/553 |
| 5,760,356 | A | | 6/1998 | Garcia et al. | 200/302.2 |
| 5,860,516 | A | * | 1/1999 | Geppert | 200/553 |
| 6,013,885 | A | * | 1/2000 | Kowalczyk | 200/315 |
| 6,118,234 | A | * | 9/2000 | Marcellus et al. | 318/63 |
| 6,180,905 | B1 | * | 1/2001 | Pollock et al. | 200/527 |

FOREIGN PATENT DOCUMENTS

GB 2183913 A * 6/1987

* cited by examiner

*Primary Examiner*—P. Austin Bradley
*Assistant Examiner*—Lisa N. Klaus
(74) *Attorney, Agent, or Firm*—Timothy J. Ziolkowski

(57) ABSTRACT

The invention includes a switch and sealing arrangement that provides positive sealing and is easy to assemble. The invention includes a switch housing having an upper compartment that is in communication with an exterior of the switch housing and has drainage slots therein. The upper compartment is separated from a lower compartment by an inner base in which a cylindrical barrel extends upwardly from the inner base. The lower compartment of the switch housing receives an electrical contact switch therein that is controlled by an actuator lever that is in contact with a post extending through the cylindrical barrel from a rocker button. A seal is provided that has an outer lip and an inner opening and is mounted on the upwardly extending cylindrical barrel such that the outer lip engages an outer surface of the cylindrical barrel. The post of the rocker button fits into the inner opening of the seal and seals the lower compartment from upper compartment when the rocker button is engaged to the switch housing. The rocker button is constructed to be removeably snap fit to the switch housing. The seal is constructed to allow the post of the rocker button to pivot without causing stress on the periphery of the seal.

14 Claims, 3 Drawing Sheets

ROCKER SWITCH AND SEAL ARRANGEMENT

BACKGROUND OF THE INVENTION

The present invention relates generally to electrical switches, and more particularly, to a rocker switch having a molded cylindrical seal mounted on an upwardly cylindrical barrel located in an upper compartment of a switch housing.

Sealing electrical switches from moisture penetration is well known in the art. For example, in a switch having a switch housing and a cover, it is known to interpose a seal member across the entire peripheral mating surfaces of the housing and the cover. The prior art also suggests that it is effective, particularly for electrical switches, to mold the seal member directly to an outer peripheral mating surface of the switch housing for secure and precise positioning thereof. Such additional molding could be accomplished by injection molding, which utilizes separate molding dies to hold the switch housing therebetween and injects an elastic material to form the seal member around the top periphery of the switch housing. In this design, however, there remains a problem that, when separating the molding dies after injection-molding of the seal member, the seal member may be pulled in opposite directions as the dies are removed, which may separate the seal from the switch housing, thereby defeating the purpose of this injection molding technique.

Attempts have been made to overcome the above problem by providing a seal for an actuator opening in a switch housing wherein the seal is separately mounted between peripheries of the switch housing and the cover. One such seal for electrical switches that has a non-removable rocker button includes a one-piece diaphragm seal that covers the entire top end of the switch housing to seal the interior of the switch base from the outside. The diaphragm seal is placed across the entire open end of the frame, and two depending posts of a rocker button extend through the seal. This particular construction relies on uniform engagement of the face edges of the base and the frame to properly maintain the seal in position. However, the constant movements of the rocker button stresses the seal near the center, which can pull away if the two faces are not uniformly clamped, thus allowing moisture into the switch.

Another switch sealing arrangement includes placing an O-rings seal into a tower. The O-rings is inserted blindly from the bottom of the frame and held in place by the switch actuator, which is also inserted from the bottom of the frame into pivots. The switch actuator and seal are retained in the pivoted location by attachment of the switch base and movable contacts. The post of the rocker button is inserted into a hole in the actuator. However, this arrangement is difficult and time consuming to assemble.

In view of the aforementioned problems, it would therefore be desirable to design an improved switch and seal arrangement that effectively seals the switch interior without placing undue stress on the sealing arrangement due to prolonged switch use, and that is also easy to assemble.

SUMMARY OF THE INVENTION

The present invention provides a switch and sealing arrangement that 1) improves sealing capability of the rocker switch, 2) provides an arrangement that minimizes distortion or stress to the seal, 3) allows easy assembly of the switch and seal, 4) permits for a removable rocker button, and 5) provides a plurality of apertures to allow fluid drainage from the switch and therefore, overcomes the shortcomings of the prior art.

Accordingly, the present invention includes a switch housing having an upper compartment, a lower compartment, and an inner base. The upper compartment is in communication with an exterior of the switch housing, and the lower compartment is defined by a plurality of walls extending from the upper compartment to receive an electrical contact assembly therein. The inner base extends across the switch housing and separates the lower compartment from the upper compartment and has a cylindrical barrel extending upwardly therefrom. The invention also includes a seal and a rocker button mounted on the upper compartment of the switch housing. The seal has an outer lip and an inner opening and is mounted on the upwardly extending cylindrical barrel. The outer lip of the seal is fitted on an outer surface of the cylindrical barrel. The rocker button is positioned in the upper compartment of the switch housing and is engageable thereto. The rocker button has a post extending downwardly therefrom that is insert into the inner opening of the seal to thereby seal the lower compartment from the upper compartment.

In accordance with another aspect of the invention, a switch housing has an upper compartment that is in communication with the exterior of the switch housing, an inner base, a cylindrical barrel extending upwardly from the inner base, and a plurality of apertures open into the atmosphere to allow drainage from the upper compartment. The cylindrical barrel defines an upper end of a switch cavity. The switch housing also includes a seal and a rocker button mounted on the upper compartment of the switch housing. The seal has an outer lip and an inner opening and is mounted on the upwardly extending cylindrical barrel such that the outer lip is fitted on an outer surface of the cylindrical barrel. A rocker button is engageable with the switch housing and has a post centrally located and extending downwardly from the rocker button. When assembled, the post is inserted into the inner opening of the seal to thereby seal the switch housing from the exterior. The switch housing further includes a pair of lugs molded on opposite sides of the upper compartment to snap fit the rocker button to the switch housing. The rocker button also includes a pair of prongs on opposite sides of the rocker button to snap fit with the pair of the lugs.

Various other feather, objects and advantages of the present invention will be made apparent from the following detailed description and the drawings.

BRIEF DISCRIPTION OF THE DRAWINGS

The drawings illustrated the best mode presently contemplated for carrying out the invention.

DETAILED DISCRIPTION OF THE INVENTION

Figure 1:
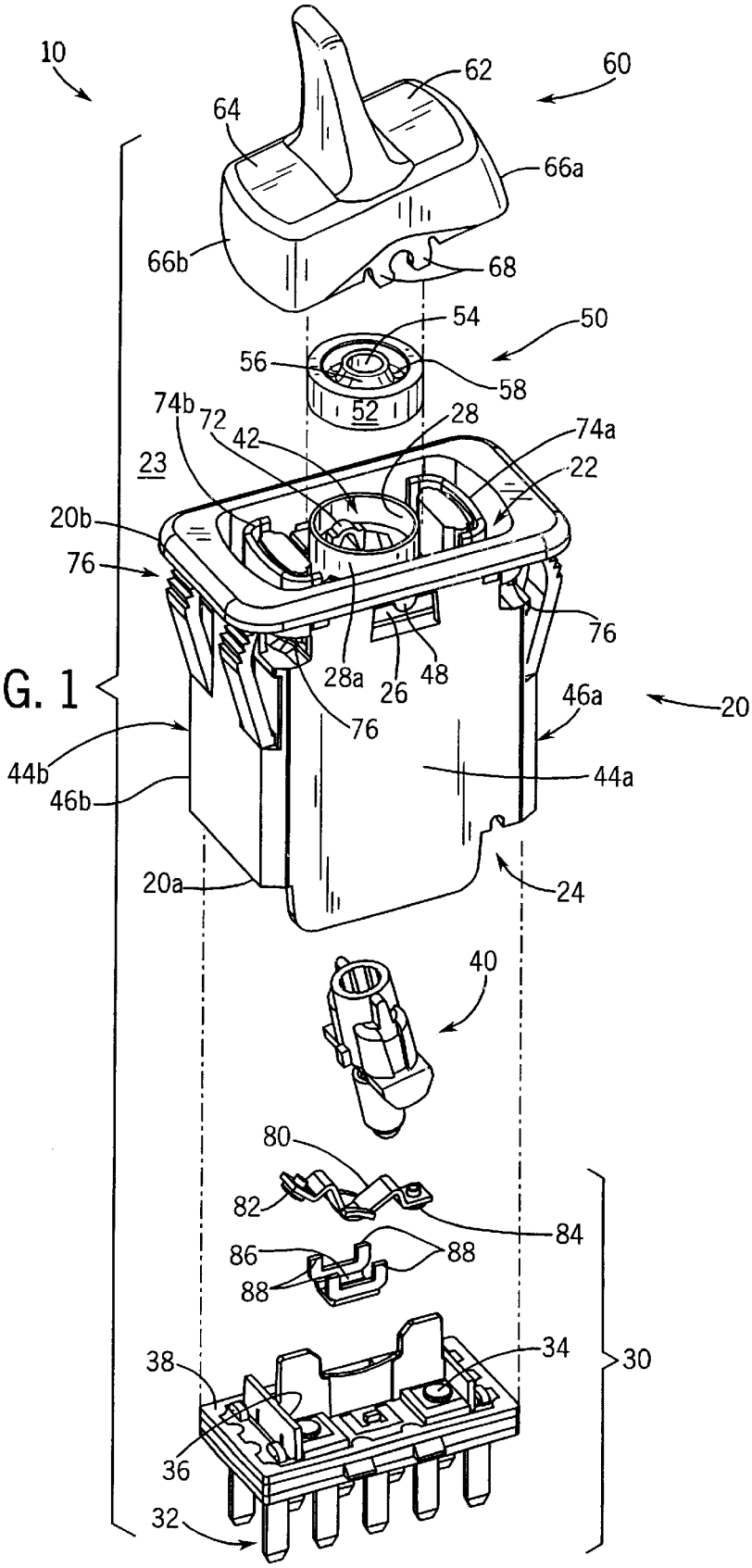
FIG. 1 is an exploded perspective view of a switch constructed in accordance with present invention.

Referring to FIG. 1, there is shown an illustrative electrical switch 10 constructed in accordance with the present invention. In a preferred embodiment, switch 10 is a rocker switch, but one skilled in the art will readily recognize that the invention is equally and equivalently applicable to toggle switches, or any other pivotal-type switch, hereinafter generally referred to as rocker switches.

The main components of the rocker switch 10 includes a switch housing 20 having a contact assembly 30 and an actuator lever 40 assembled into a bottom portion 20*a* of the switch housing 20. A seal 50 and a rocker button 60 are assembled to a top portion 20*b* of switch housing 20.

The switch housing 20 includes front and rear walls 44*a*, 44*b*, and a pair of opposed side walls 46*a*, 46*b* connecting the front and rear walls 44*a* and 44*b* to one another and extending downward from the top portion 20*b* of the housing 20 to form a lower compartment 24. The switch housing 20 further includes an upper compartment 22 in which an inner base 26 separates the upper compartment 22 from the lower compartment 24. The upper compartment 22 is in communication with an exterior 23 of the switch housing 20 and has a plurality of apertures 76 to allow drainage of any fluid that may enter the upper compartment 22 around the rocker button 60. The upper compartment 22 also includes a pair of lugs 48 molded on opposite sides of the housing to snap fit the rocker button 60 to the switch housing 20.

A cylindrical barrel 28 extends upwardly from the inner base 26 and has an opening 42 therein. A pair of pivots 72 extend inward within the cylindrical barrel 28 to retain and allow rotation of actuator lever 40 within the switch housing 20. The opening 42 is the only opening between the upper compartment 22 and the lower compartment 24. In other words, the inner base 26 seals the upper compartment 22 from the lower compartment 24, other than opening 42 in cylindrical barrel 28.

The contact assembly 30 fits in the lower compartment 24 and is actuated by the actuator lever 40, which pivots with the rocker button 60. The contact assembly includes at least one pair of stationary contacts 34, 36 and a plurality of terminals 32 connected to the stationary contacts 34, 36 and projecting outwardly from the switch 10, when assembled, to engage a wire harness (not shown), as is well known. A movable contact bridge 80 has a pair of movable contacts 82, 84 mounted thereon at opposite ends of the movable contact bridge 80 to switch between the stationary contacts 34, 36 with motion by the actuator lever 40. The movable contact bridge 80 is pivotably mounted on a bridge support 86 which is staked to a center one of the terminals 32. The movable contact bridge 80 interfits within four spaced upstanding lugs 88 integral with the bridge support 86. This arrangement permits the movable contact bridge 80 to pivot with the rocker button 60 so as to engage selectively the movable contacts 82, 84 with the stationary contacts 34, 36.

Figure 2:
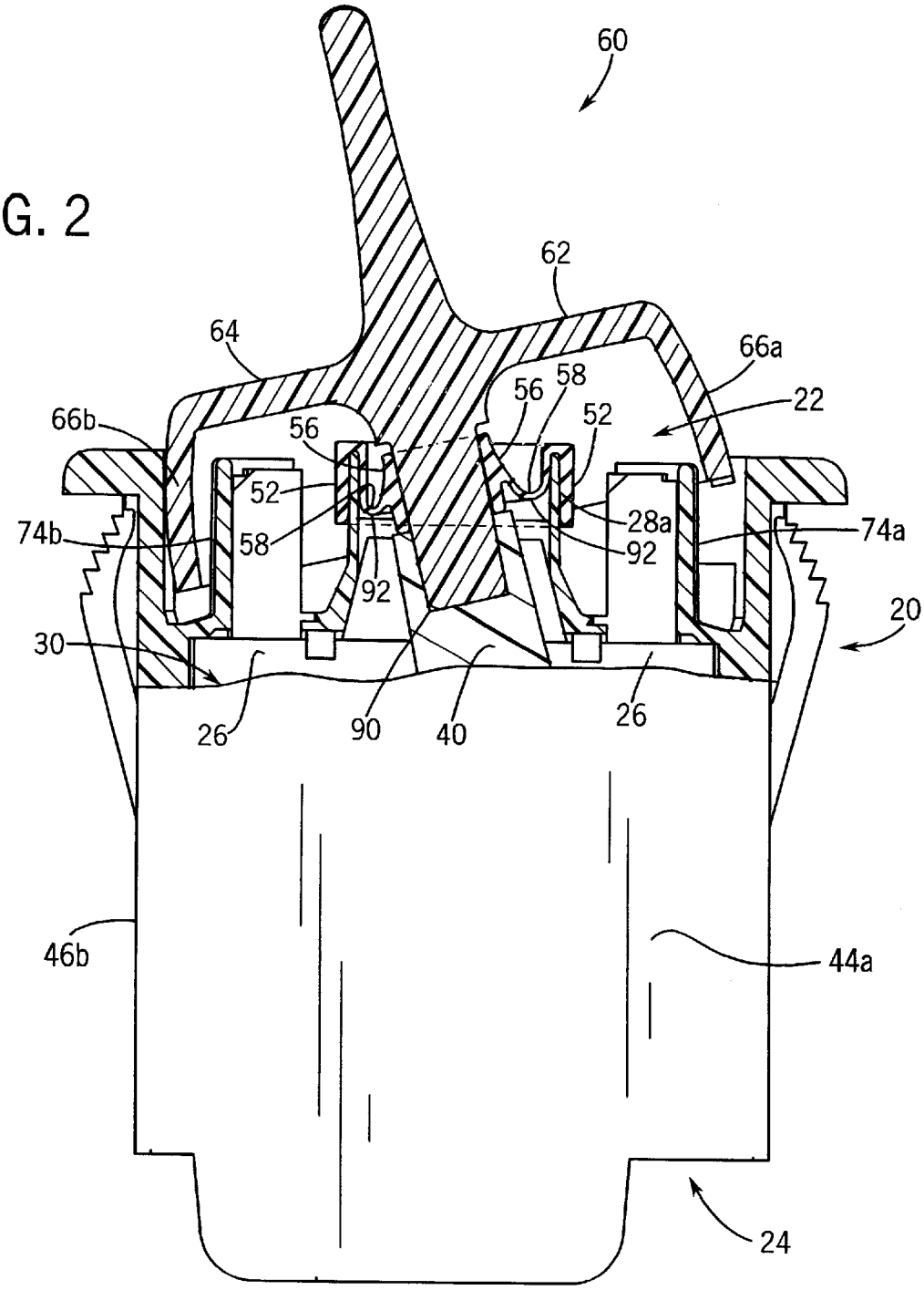
FIG. 2 is partial cross sectional view of the switch of FIG. 1.

As indicated in FIG. 1, and better shown in FIG. 2, the seal 50 has an outer lip 52 and an inner opening 54. The seal 50 is placed over the cylindrical barrel 28 of the switch housing 20 to seal the lower compartment 24, from the upper compartment 22 and the exterior 23. The outer lip 52 engages an outer surface 28*a* of the cylindrical barrel 28. The rocker button 60 has a downwardly extending post 90 that engages the inner opening 54 of seal 50 when the rocker button 60 is mounted to and attached to the housing 20.

The rocker button 60 further includes a pair of laterally-aligned prongs 68 on opposite sides thereof that snap fit into the pair of the lugs 48 as mentioned above. The rocker button 60 acts as a housing cover for the switch 10. This pivotal rocker button 60 has upwardly inclined opposing portions 62, 64 that may alternately be pressed to open and close the respective contacts of the switch 10. The cylindrical post 90 is centrally molded, integral with the rocker button 60, and extends downwardly therefrom. When the rocker button 60 is engaged to the switch housing 20, the seal 50 acts to seal the upper compartment 22 and the exterior 23, from the contact assembly 30 in the switch cavity (i.e., the lower compartment 24).

Referring particularly to FIG. 2, in order to limit the pivot motion of rocker button 60, the rocker button 60 is provided with downwardly extending oppositely disposed walls 66*a* and 66*b*. The upper compartment 22 is provided with inwardly directed, oppositely disposed shoulders 74*a* and 74*b*. Each of the shoulder 74*a* or 74*b* of the upper compartment 22 are positioned to abut the lower edge of one of the oppositely disposed walls 66a and 66*b* of the rocker button 60 when the rocker button 60 is pivoted a predetermined distance. In the illustrated embodiment, the shoulders 74*a* and 74*b* and oppositely disposed walls 66*a* and 66*b* are arranged to permit the rocker button 60 to toggle the contact bridge 80 to switch engagement between movable contact 82 and stationary contact 36 to and from engagement of movable contact 84 with stationary contact 34.

To translate movements of the rocker button 60 into changes in the electrical condition of the switch 10, the cylindrical post 90 is operably connected to the actuator lever 40 such that, as the rocker button 60 is pivoted in one direction, the lever 40 rocks the movable contact bridge 80 in the opposite direction. The interaction of oppositely disposed walls 66*a* and 66*b* and shoulders 74*a* and 74*b* permits the rocker button 60 to toggle between two extreme positions by applying appropriate pressure to upper surface 62 or 64 of the rocker button 60. For example, one of the two extreme positions is illustrated in FIG. 2. The other extreme position occurs when the rocker button 60 is pivoted to the side opposite of that shown in FIG. 2.

To assemble the switch 10, the contact assembly 30 and the actuator lever 40 are inserted in the lower compartment 24. The seal 50 is mounted on the cylindrical barrel 28. The cylindrical post 90 of the rocker button is inserted downwardly into the inner opening 54 of the seal 50, and the pair of laterally-aligned prongs 68, on opposite sides of the rocker button 60, are snapped onto the pair of lugs 48 that are molded on opposite sides of the upper compartment 22.

Figure 3:
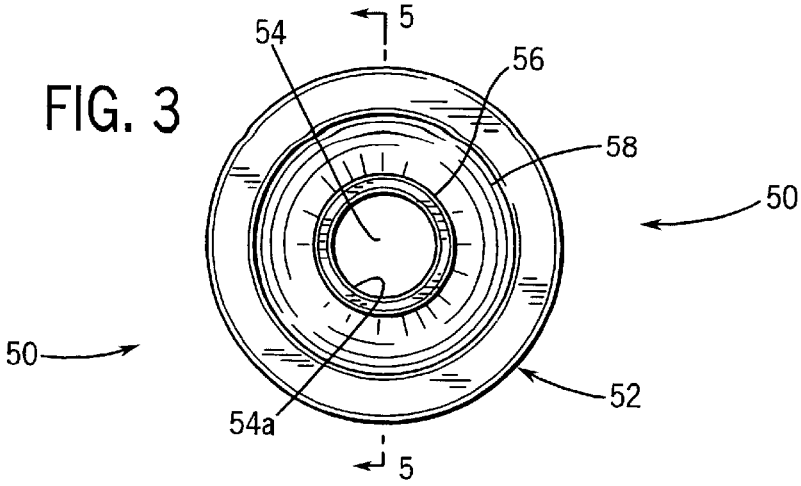
FIG. 3 is a top plan view of a cylindrical seal as used in the switch of FIG. 1.
Figure 4:
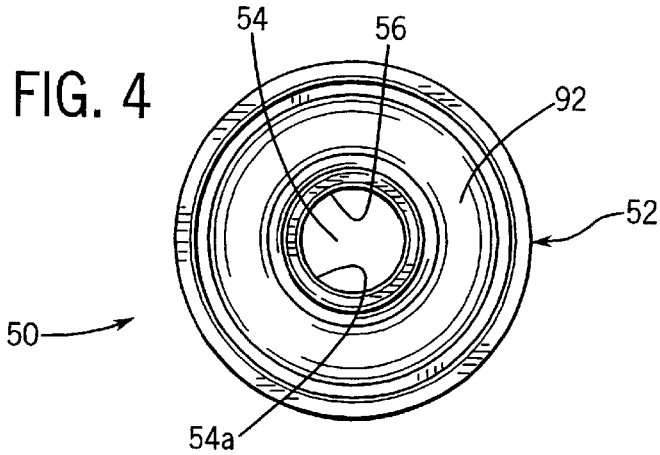
FIG. 4 is a bottom plan view of the cylindrical seal of FIG. 3.
Figure 5:
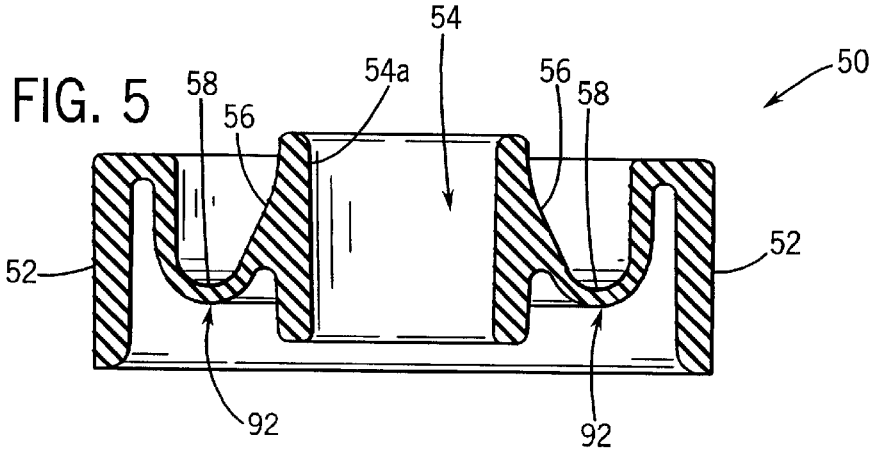
FIG. 5 is a cross-sectional view of the seal taken along line 5—5 of FIG. 3.

Referring to FIGS. 3–5, where FIG. 3 is a top view of seal 50, FIG. 4 is a bottom view of seal 50, and FIG. 5 is a cross-sectional view of seal 50, the seal 50 is generally cylindrical and preferably made entirely of resiliently flexible material, such as rubber or a rubber composite. The seal 50 has an outer lip 52, an inner opening 54, and a frusto-conical outer surface 56. The seal 50 includes a land 58 that bridges an inner surface 54*a* to the outer lip 52. The inner surface 54*a* defines the inner opening 54. Referring particularly to FIGS. 4 and 5, the lower surface of the seal 50 includes structure for locating and retaining the seal 50 with respect to the cylindrical barrel 28 that provides a tighter seal therebetween. This structure includes a curved, convex surface 92 that allows the seal 50 to flex with the rocker button 60 and the downwardly extending post 90 moves from one position to the next. This structure and arrangement allows rocker button movement without causing distortion or stress on the sealing arrangement. Further, this particular structure and arrangement simplifies assembly over prior art sealing arrangements. Since there are no blind assembly steps with the present invention, a production line for this switch can be fully automated. Additionally, since the rocker button 60 is removable, it is possible to easily replace the rocker button 60 and/or the seal 50 by simply pulling the rocker button 60 off with finger force, replacing the button and/or seal, and snap-fitting the rocker button 60 back to the housing 20.

The present invention has been described in terms of the preferred embodiment, and it is recognized that equivalents, alternatives, and modifications, aside from those expressly stated, are possible and within the scope of the appending claims.

I claim:

1. A rocker switch comprising:

a switch housing having an upper compartment, a lower compartment, and an inner base, the upper compartment being in communication with an exterior of the switch housing, the lower compartment is defined by a plurality of walls extending downwardly from the upper compartment and receives an electrical contact switch therein, and the inner base extends across the switch housing and separates the lower compartment from the upper compartment and has a cylindrical barrel extending upwardly therefrom;

a seal having an outer lip and an inner opening, the seal mounted on the upwardly extending cylindrical barrel such that the outer lip seats on an outer surface of the cylindrical barrel; and a rocker button is positioned in the upper compartment of the switch housing and is engageable therein, the rocker button having a post extending downwardly therefrom that fits into the inner opening of the seal to thereby seal the lower compartment from upper compartment.

2. The rocker switch of claim 1 wherein the switch housing further comprises a plurality of apertures to allow fluid drainage from the upper compartment.

3. The rocker switch of claim 1 wherein the switch housing further comprises a pair of lugs molded on opposite sides of the upper compartment to snap fit the rocker button to the switch housing.

4. The rocker switch of claim 3 wherein the rocker button further comprises a pair of semi-cylindrical, lateral grooves on opposite sides of the rocker button in alignment with one another to snap fit with the pair of lugs.

5. The rocker switch of claim 1 wherein the seal is entirely made of resiliently flexible material.

6. The rocker switch of claim 1 wherein the seal further comprises a land that bridges the inner opening of the seal to the outer lip of the seal.

7. The rocker switch of claim 1 wherein the seal is cylindrically shaped.

8. The rocker switch of claim 1 wherein an outer surface of the inner opening of the seal is frustoconical shaped.

9. A rocker switch and sealing arrangement comprising:

a switch housing having an upper compartment that is in communication with an exterior of the switch housing, the switch housing also comprising an inner base having a cylindrical barrel extending upwardly from the inner base, wherein the cylindrical barrel defines an upper end of a switch cavity;

a seal having an outer lip and an inner opening, the seal engageable on the cylindrical barrel such that the outer lip engages on an outer surface of the cylindrical barrel;

a rocker button engageable with the switch housing and having a post centrally located and extending downwardly from the rocker button, the post fitting into the inner opening of the seal to thereby seal the switch cavity from the upper compartment when the rocker button is engaged to the switch housing; and wherein the seal is constructed to allow the post of the rocker button to pivot without causing stress on the periphery of the seal.

10. The rocker switch of claim 9 wherein the rocker button is constructed to be removeably snap fit into the switch housing.

11. The rocker switch of claim 9 wherein the post is cylindrical and molded integrally with the rocker switch.

12. The rocker switch of claim 9 wherein the rocker button is pivotally supported within the switch housing and has a plurality of operable positions.

13. The rocker switch of claim 9 wherein the cylindrical barrel further comprises a pair of pivots extended inward of the cylindrical barrel to retain an actuator lever within the switch cavity.

14. The rocker switch of claim 9, wherein the switch housing further comprises a pair of laterally-aligned lugs molded on opposite sides of the upper compartment to snap fit the rocker button to the switch housing, and wherein the rocker button further comprises a pair of laterally-aligned prongs on opposite sides thereof to snap fit into the pair of laterally-aligned lugs.

* * * * *